US008062066B1

(12) United States Patent
Hsieh

(10) Patent No.: US 8,062,066 B1
(45) Date of Patent: Nov. 22, 2011

(54) SIGNALING CABLE WITH FLEXIBLE METALLIC SHIELDING

(75) Inventor: Chang-Cheng Hsieh, Taipei (TW)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/837,273

(22) Filed: Jul. 15, 2010

(51) Int. Cl.
*H01R 13/648* (2006.01)

(52) U.S. Cl. ..... 439/607.41

(58) Field of Classification Search ..... 439/680, 439/607.41, 607.52, 607.47
See application file for complete search history.

(56) References Cited

U.S. PATENT DOCUMENTS 6,447,314 B1 9/2002 Kato et al.
6,855,013 B2 2/2005 Chiang et al.
6,951,477 B2 * 10/2005 Tondreault et al. ..... 439/497
7,328,047 B2 2/2008 Zhu et al.
2008/0293292 A1 11/2008 Wu et al.
2010/0029133 A1 * 2/2010 Cheng ..... 439/607.47

FOREIGN PATENT DOCUMENTS

CN 2667715 Y 12/2004

* cited by examiner

*Primary Examiner* — Phuong Dinh
(74) *Attorney, Agent, or Firm* — Scott Gallert

(57) ABSTRACT

Apparatus and methods are provided directed to signal cabling. An illustrative cable includes first and second connectors. Each connector includes a plurality of electrical contacts supported by an insulator material. A plurality of distinct signaling conductors couples respective pairs of the electrical contacts. Each connector also includes a metallic shell continuously spanning an outer dimensional aspect of the connector. A flexible metallic shield is electrically bonded to the respective metallic shells and envelopes the signaling conductors, spanning a length-wise aspect of the cable. The signal propagation qualities of the cable are applicable to high-resolution video and other endeavors.

10 Claims, 4 Drawing Sheets

SIGNALING CABLE WITH FLEXIBLE METALLIC SHIELDING

BACKGROUND

Cables of respective configurations are used to propagate electrical signals between various devices and systems. High-resolution video requires signal cabling of appropriate electrical characteristics, particularly noise rejection. The present teachings are directed to the foregoing and related concerns.

BRIEF DESCRIPTION OF THE DRAWINGS

The present embodiments will now be described, by way of example, with reference to the accompanying drawings, in which.

DETAILED DESCRIPTION

Introduction

Methods and apparatus directed to signal cabling are provided. An illustrative cable includes first and second connectors. Each connector includes a plurality of electrical contacts supported by an insulator material. A plurality of distinct signaling conductors couples respective pairs of the electrical contacts. Each connector also includes a metallic shell continuously spanning, or nearly so, an outer dimensional aspect of the connector. A flexible metallic shield is electrically bonded to the respective metallic shells and envelopes the signaling conductors. The flexible metallic shield spans most or all of a length-wise aspect of the cable. The signal propagation qualities of the cable are applicable to high-resolution video and other endeavors.

In one embodiment, an apparatus includes a connector, in turn including an insulator material and a plurality of electrical contacts supported by the insulator material. The apparatus also includes a plurality of signaling conductors coupled to respective ones of the electrical contacts. The apparatus also includes a metallic shell disposed over the insulator material. The metallic shell is configured to define a plurality of solderable pad areas. The apparatus further includes a flexible metallic shield electrically bonded to the metallic shell and disposed about the plurality of signaling conductors. Each of the signaling conductors is electrically isolated from the metallic shell and the flexible metallic shield.

In another embodiment, a signaling cable includes a first connector, and a second connector that is electrically coupled to the first connector by way of a plurality of electrically distinct conductors. Each of the first and second connectors includes a metallic shell spanning at least a majority of an outer dimension of the respective connector. The signaling cable also includes a flexible metallic shield material disposed about the electrically distinct conductors. The flexible metallic shield material is electrically bonded to the respective metallic shells of the first and second connectors.

In yet another embodiment, a method includes coupling a plurality of signaling conductors to respective ones of a plurality of electrical contacts of a connector. The method also includes disposing a metallic shell over at least a majority of a width-wise or circumferential aspect of the connector. The method further includes electrically bonding a flexible metallic material to the metallic shell. The flexible metallic material envelopes or surrounds the signaling conductors and extends away from the connector.

First Illustrative Apparatus

Figure 1:
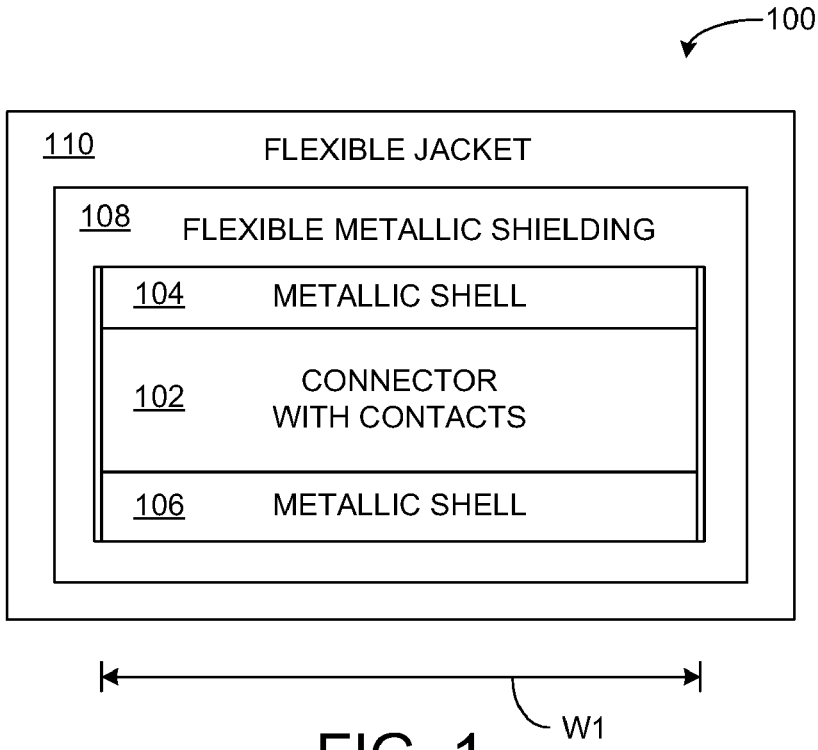
FIG. 1 is a block schematic diagram of apparatus details according to one embodiment.

Reference is now directed to FIG. 1, which depicts a block schematic view of an apparatus 100. The apparatus 100 is illustrative and non-limiting with respect to the present teachings and is depicted in block diagram form in the interest of clarity. Thus, other apparatuses and devices can be configured and/or operated in accordance with the present teachings.

The apparatus 100 includes a connector 102. The connector 102 includes a plurality of distinct electrical contacts (not shown; described further below) supported in an electrically non-conductive or insulating material. In one embodiment, the insulating material is formed from thermoplastic. Other suitable materials can also be used. In turn, the electrical contacts can be of any practical count, arrangement or form factor.

Electrically distinct signal conductors (not shown; described further below) are coupled to respective ones of the electrical contacts and extend away from the connector 102. The apparatus 100 is a portion of a signaling cable for propagating or connecting various electrical signals between respective entities. The connector 102 is configured to be removably engaged with a corresponding entity (not shown). Electrical coupling is thus established between the plural electrical contacts of the connector 102 and a corresponding number of other contacts of the entity.

The apparatus 100 also includes a metallic shell 104 and a metallic shell 106. The metallic shells 104 and 106 are disposed in contact with respective, opposite width-wise aspects "W1" of the connector 102. Each of the metallic shells 104 and 106 spans the width dimension "W1" of the connector 102 and is electrically bonded to various metallic elements and features present or optionally present at the outside surface of the connector 102. Each of the metallic shells 104 and 106 is an element in an electrical grounding and electromagnetic interference (EMI) shielding scheme of the apparatus 100.

The apparatus 100 also includes a flexible metallic shielding (shielding) 108. The shielding 108 can be formed from aluminum foil, gold foil, a thin layer of metal supported by a flexible polymer, etc. Other forms of shielding 108 can also be used. The shielding 108 is disposed about the connector 102 and is bonded in electrically conductive contact with the metallic shells 104 and 106. The shielding 108 is configured to envelope or surround the signal conductors and define an element in the electrical grounding and interference shielding of the apparatus 100.

The apparatus 100 further includes a flexible, electrically-insulating jacket 110. The jacket 110 can be formed from vinyl or another suitable material. The jacket 110 envelopes the flexible metallic shielding 108 and the signaling conductors, and defines the outer-most material aspect of the apparatus 100. The elements 102-110, inclusive, define respective features of a signaling cable configured for use with high-resolution video signaling, instrumentation or data acquisition, or other applications.

Second Illustrative Apparatus

Figure 2A:
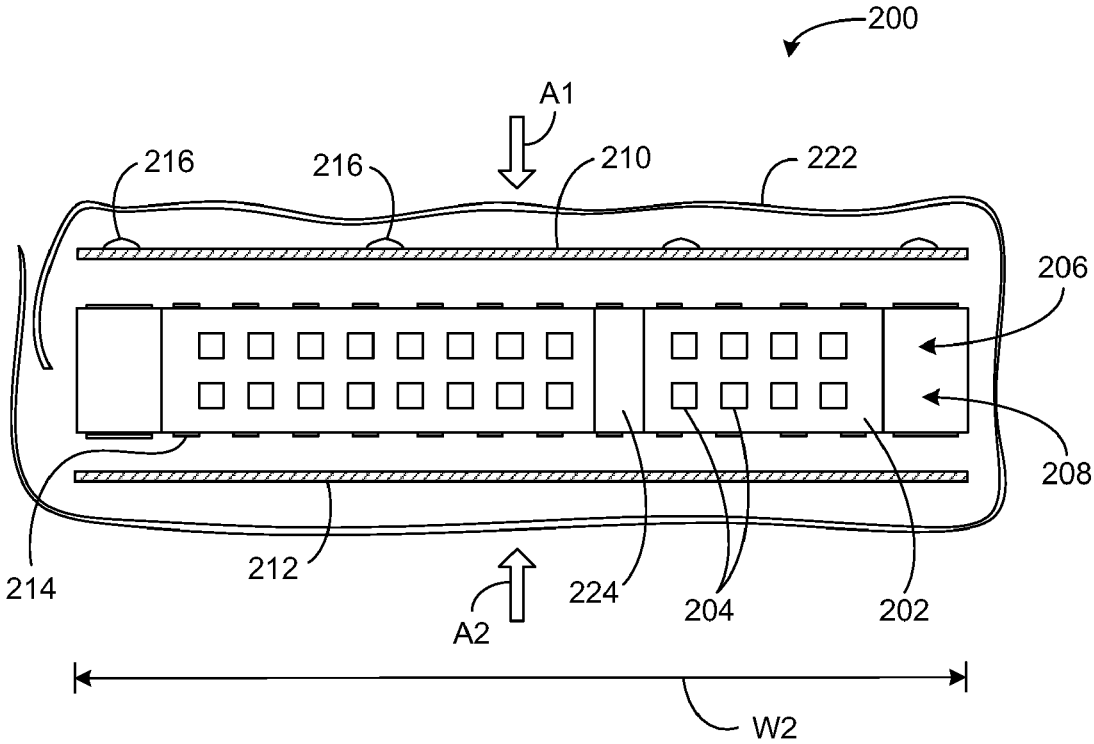
FIG. 2A is an exploded end elevation view of an apparatus according to another embodiment.
Figure 2B:
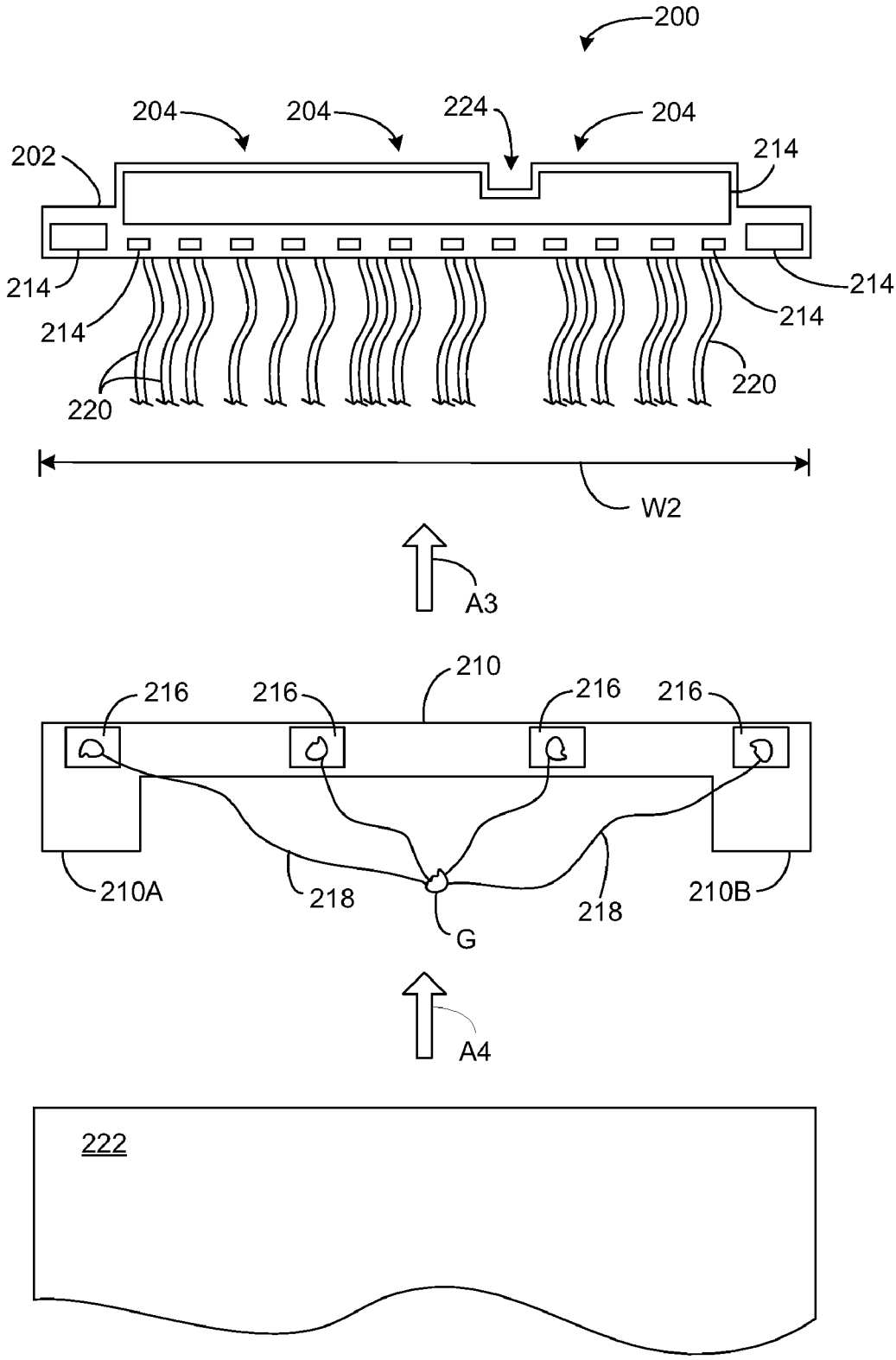
FIG. 2B is an exploded plan view of portions of the apparatus according to FIG. 2A.

Attention is now directed to FIGS. 2A and 2B. FIG. 2A depicts an exploded end elevation view of a signaling cable arrangement 200 according to another embodiment. FIG. 2B depicts an exploded plan view of portions of the arrangement 200. The arrangement 200 is illustrative and non-limiting with respect to the present teachings. Thus, other apparatuses, devices or systems, optionally including other features or variations, can be configured or operated in accordance with the present teachings.

The arrangement 200 includes a connector or connector body 202. The connector 202 is formed from plastic, thermoplastic or another suitable electrically non-conductive material. In one embodiment, the connector 202 is formed using injection molding or other known techniques. Other formative procedures can also be used.

The connector 202 includes a plurality of electrical contacts 204. Each of the electrical contacts 204 is defined by metal or another electrically conductive material and is supported by the connector body 202. The electrical contacts 204 are supported in a spaced linear pattern such that a row 206 and a row 208 are defined. Each row 206 and 208 includes twelve electrical contacts 204. In one embodiment, each of the electrical contacts 204 has a female form-factor. Male or other form-factors can also be used.

It is to be understood that any suitable number of electrical contacts 204 can be used in accordance with other embodiments. The particular count of twelve contacts per row, or twenty-four total, is illustrative and non-limiting in nature. Furthermore, electrical contacts can be arranged in any number of rows or patterns. Each of the rows 206 and 208 of electrical contacts 204 is arranged parallel to a width-wise dimension "W2" of the connector 202.

The arrangement 200 includes a first metallic shell or plate 210 and a second metallic shell (or plate) 212. The metallic shells 210 and 212 are depicted spaced apart from the connector 202 in the interest of clarity. However, it is to be understood that the respective metallic shells 210 and 212 are in direct contact with opposite sides of the connector 202 in a normal, fully assembled state as indicated by assembly arrows "A1"-"A4", respectively. The metallic shells 210 and 212 can be formed from aluminum, copper, gold, or another suitable metal or alloy and are rigid or semi-rigid in nature. It is noted that at least the metallic shell 210 is defined by opposite extension portions 210A and 210B, respectively.

The metallic shell elements 210 and 212 span all—or nearly all—of the width "W2" of the connector 202. In another embodiment, the metallic shell elements 210 and 212 span at least a majority portion of the width "W2" of the connector body 202. The metallic shell elements 210 and 212 are configured to electrically bond various metallic aspects 214 such as, for non-limiting example, assembly tabs, fasteners, rivets, stiffeners, shielding plates, grounding planes or other elements of the connector 202 to a common grounding node "G". In one or more embodiments, one or more of the electrical contacts 204 is electrically bonded to the grounding node, as well.

The metallic shell 210 includes or is defined by a plurality of solderable pad areas 216. Each of the areas 216 is configured to be electrically coupled to the common grounding node "G" by way of a respective ground wire 218. In turn, each of the electrical contacts 204 is coupled or electrically bonded to a respective signaling conductor 220. Each of the signaling conductors 220 is insulated so as to remain electrically isolated from the other signaling conductors 220, the metallic shells 210 and 212, and other ground aspects of the arrangement 200 or a signaling cable inclusive thereof.

The arrangement 200 further includes a flexible metallic shielding material 222. The shielding material 222 can be defined by a thin metal foil such as aluminum, gold, etc. In another embodiment, the shielding material 222 is defined by a thin layer of metal formed on or supported by a flexible polymer. The flexible metallic shielding material 222 is configured to surround the signaling conductors 220 so as to attenuate the effects of EMI from external sources.

The shielding material 222 is also electrically bonded to the metallic shells 210 and 212 when the arrangement 200 is in a fully assembled state. In particular, the shielding material 222 is continuously bonded to the metallic shells 210 and 212 along at least a majority portion of the width "W2". The shielding material 222 is thus electrically grounded during normal operations.

The connector 202 is further configured to define a keying feature 224. The keying feature 224 is in the form of a notch or indentation disposed part way along the width aspect "W2" of the connector 202 and operates to aid in proper coupling (rotation or orientation) of the connector 202 to another entity. Other embodiments omitting such a keying feature can also be defined and used.

First Illustrative Signaling Cable

Figure 3:
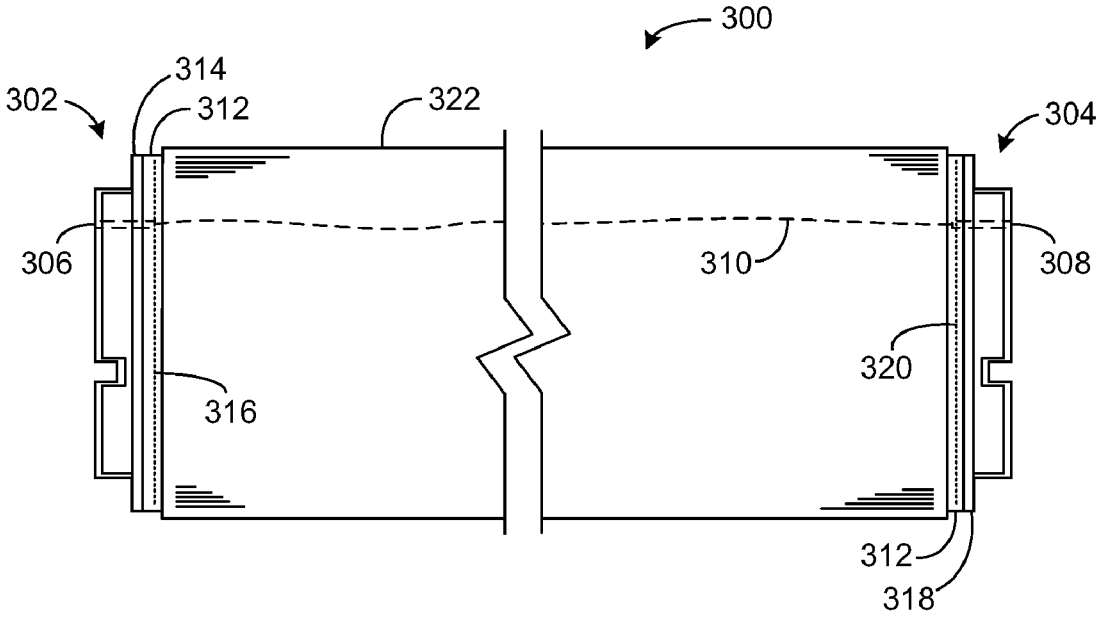
FIG. 3 is a plan view depicting a signaling cable according to one embodiment.

Attention is now directed to FIG. 3, which depicts a plan view of a signaling cable 300. The cable 300 is illustrative and non-limiting with respect to the present teachings. Thus, other signaling cables, wiring harnesses or devices can be configured and/or operated in accordance with the present teachings.

The cable 300 includes a first connector 302 and a second connector 304. The respective connectors 302 and 304 are disposed at opposite ends of the cable 300. Each of the connectors 302 and 304 includes respective electrical contacts that are interconnected as pairs by way of corresponding signaling conductors. That is, each of the electrical contacts of the connector 302 is electrically coupled to a corresponding one of the electrical contacts of the connector 304.

An illustrative female electrical contact 306 is coupled to a female electrical contact 308 by way of a signaling conductor 310 (shown in dashed or hidden-line form, respectively). It is to be understood that a plurality of such one-to-one electrical contact associations are included in the cable 300.

The signaling cable 300 includes a flexible metallic shielding material 312 that is electrically bonded or fused to a metallic shell 314 of the connector 302 along a width-wise path or swath 316. Similarly, the flexible metallic shielding material 312 is electrically bonded (i.e., fused) to a metallic shell 318 of the connector 304 along a width-wise path or swath 320.

The signaling cable 300 also includes a flexible, electrically non-conductive outer jacket 322. The jacket 322 can be formed from vinyl or another suitable material. The jacket 322 surrounds or envelopes all or nearly all of the flexible metallic shielding material 312 and the signal conductors (e.g., 310), continuously from the connector 302 to the connector 304. The jacket 322 contributes to the overall structural strength of the cable 300 and protects internal elements against dry or wet contaminants. The jacket 322 further insulates the internal aspects of the signaling cable 300 against accidental or unintended electrical contact with other entities.

The signaling cable 300 is generally flexible along its length so that respective connectors 302 and 304 can be routed as desired and mechanically coupled to respectively different entities. Non-limiting examples of such entities include electronic circuit boards, devices, instrumentation, high-resolution video equipment, etc. The signaling cable 300 is further understood to include internal electrical grounding elements analogous to those described above with respect to arrangement 200.

Within such a grounding structure, the metallic shells 314 and 318, and the shielding material 312 cooperate to attenuate and mitigate undesirable effects of EMI from external sources that would otherwise occur. The signaling cable 300 is suitable for high-resolution video and other signal propagation applications. It is noted that the signaling cable 300 is defined by a generally flat, ribbon-like form-factor. Other embodiments of signaling cable contemplated by the present teachings can include round or oval form-factors, electrical contacts arranged in circular or semi-circular patterns, etc. Other variations and form-factors can also be used.

Second Illustrative Signaling Cable

Figure 4:
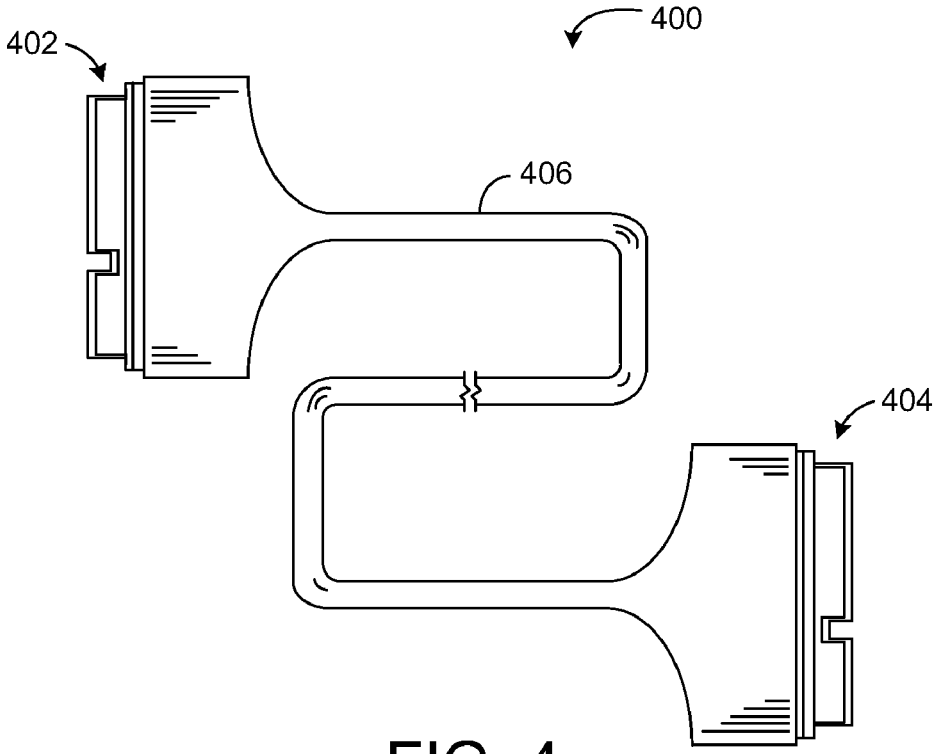
FIG. 4 is a plan view depicting a signaling cable according to another embodiment.

Reference is now made to FIG. 4, which depicts a plan view of a signaling cable 400. The cable 400 is illustrative and non-limiting with respect to the present teachings. Thus, other signaling cables, wiring harnesses or devices can be configured or operated in accordance with the present teachings.

The cable 400 includes a first connector 402 and a second connector 404. The respective connectors 402 and 404 are disposed at opposite ends of the cable 400. Each of the connectors 402 and 404 includes respective pluralities of electrical contacts that are interconnected as pairs by way of corresponding signaling conductors. The cable 400 is analogous to cable 300 in the immediately foregoing respect.

The cable 400 includes an internal ground wiring arrangement (e.g., 216, 218) electrically bonded to metallic shells (e.g., 210) of the connectors 402 and 404, a flexible metallic shielding material (e.g., 222) about the plural signaling conductors (e.g., 220), and a flexible outer jacket 406 extending from connector 402 to connector 404. In one embodiment, the internal ground wires 218 are defined by size twenty-eight AWG (American Wire Gauge) or size thirty AWG conductors. Other suitable wire sizes can also be used.

The overall constituency and construction of the signaling cable 400 are consistent with the present teachings and analogous to other elements and features described above with respect to other embodiments. However, it is noted that a majority length of the signaling cable 400 is defined by a generally round cross-sectional shape, in contrast to the ribbon-like form-factor of the signaling cable 300.

First Illustrative Method

Figure 5:
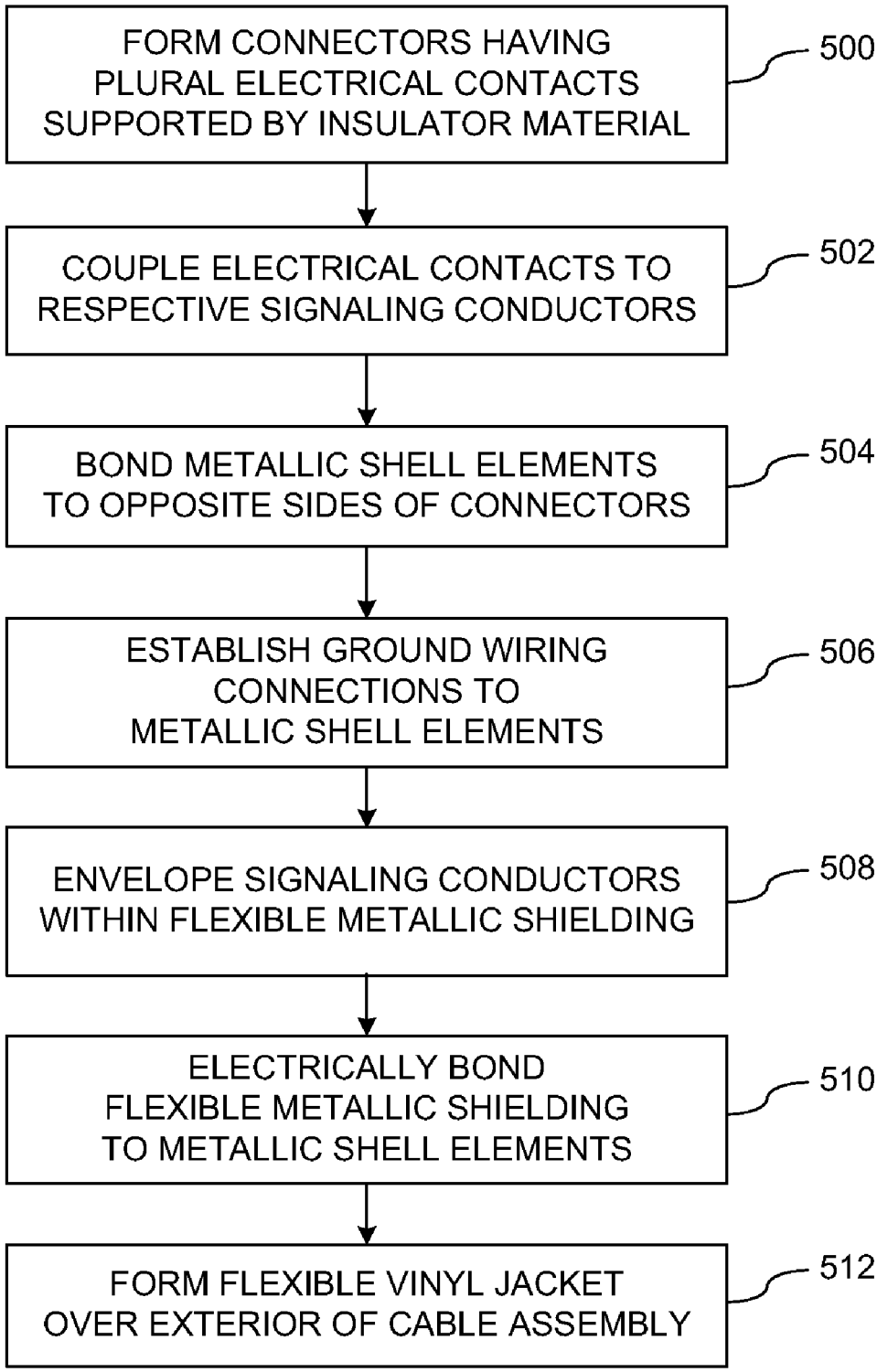
FIG. 5 is a flow diagram depicting a method of construction according to one embodiment.

Attention is directed to FIG. 5, which depicts a flow diagram of a method according to one embodiment of the present teachings. The method of FIG. 5 includes particular operations and order of execution. However, other methods including other operations, omitting one or more of the depicted operations, and/or proceeding in other orders of execution can also be used according to the present teachings. Thus, the method of FIG. 5 is illustrative and non-limiting in nature. Reference is also made to FIGS. 2A, 2B and 3 in the interest of understanding the method of FIG. 5.

At 500, one or more connectors are formed having a plurality of electrical contacts supported by insulating material. For purposes of non-limiting illustration, it is assumed that respective connectors 302 and 304 are formed from electrically non-conductive thermoplastic. A plurality of electrical contacts 306, 308, each having a female form-factor, are formed from aluminum and are supported in spaced linear adjacency within the respective connectors 302 and 304. In another embodiment, electrical contacts having a male or other form-factor can be used. As such, each of the connectors 302 and 304 has a like number of electrical contacts 306 and 308. A pair of metallic stiffening plates (e.g., 214) are also formed and bonded to each of the connectors 302 and 304.

At 502, the electrical contacts are coupled to respective signaling conductors. For purposes of the present illustration, it is assumed that each of the electrical contacts 306 and 308 is coupled or electrically bonded to a respective signaling conductor 310 defined by an insulated copper wire. Other suitable wires types can also be used. Each coupled pair of electrical contacts 306 and 308 is electrically distinct from other contacts or conductors. Thus, a plurality of pairs of coupled electrical contacts is defined.

At 504, metallic shell elements are bonded to opposite sides of each connector. For purposes of the present illustration, metallic shells 314 and 318 are bonded to respective sides of the connectors 302 and 304. Each of the metallic shells 314 and 318 spans a width-wise aspect of the respective connectors 302 and 304 and is in electrical contact the corresponding underlying stiffening plates.

At 506, ground wiring connections are established to the one or more metallic shell elements. For purposes of the present illustration, grounding wires or conductors (e.g., 218) are bonded or soldered to pad areas (e.g., 216) of the metallic shells 314 and 318. The ground wires are also electrically coupled together so that a common grounding node (e.g., "G") is defined.

At 508, the signaling conductors are enveloped within a flexible metallic shielding material. For purposes of the present illustration, a metal foil 312 formed from aluminum is wrapped around the plural signaling conductors 310. The signaling conductors 310 are thus completely sheaved within the flexible metallic shielding material 312.

At 510, the flexible metallic shielding material is electrically bonded to the one or more metallic shells. For purposes of the present illustration, the shielding material 312 is fused to the metallic shells 314 and 318 by tack welding, soldering, conductive adhesive, or another suitable process. The flexible metallic shielding material 312 is bonded in continuous line segments 316 and 320 across the width, or nearly so, of the metallic shells 314 and 318. The shielding material 312 is thus electrically bonded to, and defines an element of, an overall grounding and EMI shielding arrangement of a signaling cable 300.

At 512, a flexible vinyl jacket is formed over the exterior of the resulting cable assembly. For purposes of the present illustration, a vinyl jacket 322 is formed over the flexible metallic shielding material 312, and extends over a portion of both connectors 302 and 304. A finished cable assembly 300 is thus defined. In another embodiment, the vinyl jacket is made integral with or fused to other non-conductive exterior features of the cable assembly that are optionally included.

In general, and without limitation, the present teachings contemplate various embodiments of signaling cable. Such signaling cables include one or more connectors, each connector including a plurality of electrical contacts supported in a spaced relationship. Such electrical contact spacing can define a linear pattern, a circular or semi-circular pattern, etc. The electrical contacts are coupled to insulated signaling conductors (i.e., wires). The signaling conductors are configured to propagate respective electrical signals between connected pairs of electrical contacts.

Each connector further includes one or more metallic shell elements configured to overlap at least a length-wise aspect of the respective connector. Each metallic shell element is further configured to span a width-wise or circumferential aspect of the respective connector and to couple various metallic features of the connector to a grounding node. A flexible metallic shielding material such as a metal foil or other construct envelopes the signaling conductors and is electrically bonded to the metallic shell elements.

The flexible metallic shielding material is part of the grounding arrangement and functions as an EMI shielding element. It is noted that the flexible metallic shielding material is bonded to each metallic shell element along at least a continuous, majority portion of the width or circumference of the respective connector.

An electrically non-conductive or insulating jacket is included in one or more embodiments according to the present teachings. The jacket can be formed from vinyl or other suitable materials. The jacket covers all, or nearly all, of the underlying flexible metallic shielding material and a portion of the one or more connectors of the respective signaling cable.

Each signaling cable is a distinct entity configured to convey electrical signals between respective electrical contacts so that different entities can be coupled in signal communication with one another. Such entities can include, for non-limiting example, high-resolution video equipment, electronic displays, instrumentation, data acquisition systems, etc.

In general, the foregoing description is intended to be illustrative and not restrictive. Many embodiments and applications other than the examples provided would be apparent to those of ordinary skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An apparatus, comprising:

a connector including an insulator material and a plurality of electrical contacts supported by the insulator material;

a plurality of signaling conductors electrically coupled to respective ones of the electrical contacts;

a metallic shell disposed over the insulator material and configured to define a plurality of solderable pad areas; and a flexible metallic shield continuously electrically bonded to the metallic shell along a width or a circumference of the metallic shell and disposed about the plurality of signaling conductors, each of the signaling conductors being electrically isolated from the metallic shell and the flexible metallic shield.

2. The apparatus according to claim 1, the plural electrical contacts distributed in a spaced linear pattern within the insulator material.

3. The apparatus according to claim 1, the metallic shell defined by at least two extension portions.

4. The apparatus according to claim 1, the plurality of signaling conductors defined by a length, the flexible metallic shield disposed continuously about and along the length of the signaling conductors.

5. The apparatus according to claim 1, the connector defining a first connector having first electrical contacts, the apparatus further comprising a second connector including second electrical contacts electrically coupled to respective ones of the first electrical contacts by way of the signaling conductors.

6. The apparatus according to claim 5, the second connector also including a second metallic shell electrically bonded to the flexible metallic shield.

7. The apparatus according to claim 1 further comprising a plurality of electrical wires bonded to respective ones of the solderable pad areas, each of the electrical wires further bonded to a common grounding node.

8. The apparatus according to claim 7, each of the electrical wires being electrically isolated from any of the signaling conductors.

9. A method, comprising:

coupling a plurality of signaling conductors to respective ones of a plurality of electrical contacts of a connector;

disposing a metallic shell over at least a majority of widthwise or circumferential aspect of the connector; and electrically bonding a flexible metallic material to the metallic shell, the flexible metallic material enveloping the signaling conductors and extending away from the connector, the flexible metallic material being continuously bonded along a length or circumferential aspect of the metallic shell.

10. The method according to claim 9 further comprising electrically bonding one or more wires to respective pad areas of the metallic shell, the one or more wires further electrically coupled to a common node, the one or more wires being electrically isolated from any of the signaling conductors.

* * * * *